US008257021B2

(12) United States Patent
Lee

(10) Patent No.: US 8,257,021 B2
(45) Date of Patent: Sep. 4, 2012

(54) GAS-TURBINE ENGINE WITH VARIABLE STATOR VANES

(75) Inventor: Stuart Lee, Berlin (DE)

(73) Assignee: Rolls Royce Deutschland Ltd Co KG (DE)

( * ) Notice: Subject to any disclaimer, the term of this patent is extended or adjusted under 35 U.S.C. 154(b) by 529 days.

(21) Appl. No.: 12/498,089

(22) Filed: Jul. 6, 2009

(65) Prior Publication Data

US 2010/0014960 A1 Jan. 21, 2010

(30) Foreign Application Priority Data

Jul. 17, 2008 (DE) ..... 10 2008 033 560

(51) Int. Cl.
*F01D 9/02* (2006.01)

(52) U.S. Cl. ..... 415/12; 415/48; 415/160; 415/209.3

(58) Field of Classification Search ..... 415/12, 415/48, 160, 191, 209.3
See application file for complete search history.

(56) References Cited

U.S. PATENT DOCUMENTS

| | | | | |
|---|---|---|---|---|
| 2,809,803 | A * | 10/1957 | Featonby | 415/12 |
| 2,970,808 | A | 2/1961 | Coppa | |
| 3,904,309 | A * | 9/1975 | Keetley | 415/148 |
| 3,995,971 | A * | 12/1976 | White | 415/160 |
| 4,054,398 | A | 10/1977 | Penny | |
| 4,619,580 | A | 10/1986 | Snyder | |
| 4,752,182 | A * | 6/1988 | Zaehring et al. | 415/12 |
| 4,812,106 | A * | 3/1989 | Purgavie | 415/139 |
| 5,035,572 | A * | 7/1991 | Popp | 415/12 |
| 7,632,064 | B2 * | 12/2009 | Somanath et al. | 415/191 |
| 7,686,569 | B2 * | 3/2010 | Paprotna et al. | 415/1 |
| 8,011,882 | B2 * | 9/2011 | Mcmillan | 415/148 |
| 2006/0013683 | A1 | 1/2006 | Martindale | |
| 2007/0243061 | A1 | 10/2007 | Taylor et al. | |

FOREIGN PATENT DOCUMENTS

| | | |
|---|---|---|
| DE | 2618779 | 11/1977 |
| DE | 3913102 | 5/1990 |
| DE | 19516382 | 11/1996 |
| DE | 19909899 | 9/2000 |
| EU | 1520958 | 4/2005 |
| EU | 1531237 | 5/2005 |
| GB | 1381277 | 1/1975 |
| GB | 2 244 551 | * 12/1991 |
| JP | 58093903 | 6/1983 |

OTHER PUBLICATIONS

German Search Report dated Jun. 5, 2009 from counterpart German patent application.

* cited by examiner

*Primary Examiner* — Edward Look
*Assistant Examiner* — Liam McDowell
(74) *Attorney, Agent, or Firm* — Timothy J. Klima; Shuttleworth & Ingersoll, PLC

(57) ABSTRACT

A gas-turbine engine includes stator vanes (1) angularly variable about their longitudinal axes by actuating elements in order to control airflow supplied to downstream rotor blades (6). The actuating elements are arranged in the most confined downstream stages of the compressors and/or turbines, with these stages being exposed to high temperatures, so that stable and efficient operation is ensured. The actuating elements (8) fixed to the inner or the outer casing (4, 12) are made of a material expanding, contracting or deforming in dependence of the temperature and transmit the respective deformation to the swivellably borne stator vanes (1).

6 Claims, 5 Drawing Sheets

GAS-TURBINE ENGINE WITH VARIABLE STATOR VANES

Figure 1:
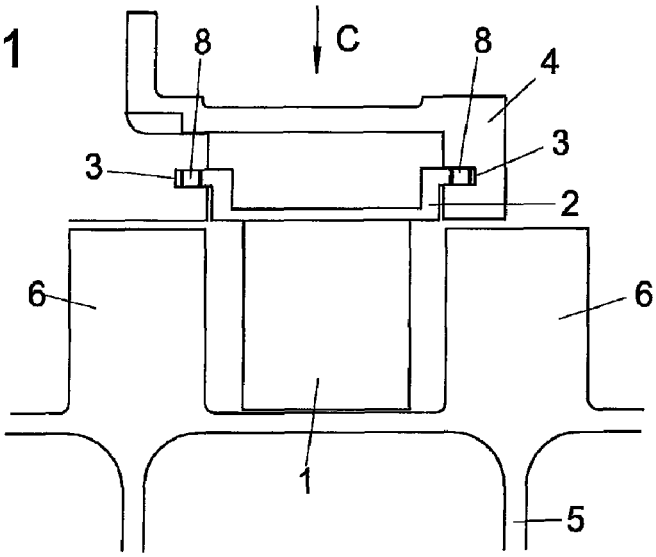

This application claims priority to German Patent Application DE102008033560.6 filed Jul. 17, 2008, the entirety of which is incorporated by reference herein.

This invention relates to a gas-turbine engine on which stator vanes (1)—allocated to the rotor blades—are angularly variable about their longitudinal axis by actuating elements in order to control the airflow supplied to the rotor blades (6).

The blading of a gas-turbine engine includes stator vanes and rotor blades. The stator vanes or guide vanes, which are fixedly arranged in the casing of the compressor or the turbine, respectively, guide the air or the hot gas at a specified angle to the rotor blades connected to a shaft, with the rotor blades converting the flow energy supplied by the stator vanes into rotary force. It is known to provide angularly variable stator vanes at the air intake of the compressors of turbomachines to produce an optimum angle of the airflow to the rotor blades of the compressor to suit the respective operating conditions, thereby improving the performance of the turbomachine and reducing fuel consumption.

The known apparatuses for controlling the angularly variable stator vanes fitted at the air intake of compressors of gas turbine engines usually have a control element in the form of a ring which is arranged around the casing of the turbomachine and, via a plurality of control levers linked to it, is firmly connected to external trunnions provided in the rotary axis of the stator vanes. Synchronized alteration of the angular position of the stator vanes is here obtained by rotating the ring about the axis of the turbomachine. Such a mechanically operated actuating mechanism for varying the angle of the stator vanes is described in Specification U.S. Pat. No. 3,325,087, for example.

The mechanically operated actuating apparatuses for the stator vanes are arranged in the forward part of the compressor for reasons of space and because the still low temperatures existing there do not affect the operation of the actuating elements. In the downstream, confined areas of the compressor and the turbine, with the latter being additionally exposed to very high temperatures, angular variability of the stator vanes is, for the above reasons, excluded from the start, in particular since the mechanical actuating mechanisms are also heavy and expensive. If the engine is to be kept at a certain—low—speed, for example during landing, stalling and the so-called surging of the engine may occur even with angularly variable stator vanes provided in the forward area, so that efficiency and stable operation of the engine are not ensured. Also in the take-off and climbing phase, reduction of the airflow in the rear part of the compressor may occur, resulting in stall and, finally, power loss of the engine.

A broad aspect of the present invention therefore is to provide a gas-turbine engine equipped with angularly variable stator vanes, which ensures operational efficiency and stability under different flight conditions.

The present invention, in its broad concept, provides for angular variability of the stator vanes, also in the downstream, confined areas of the compressor and the turbine, with these areas being exposed to high temperatures, such that operational stability and efficiency of the engine, with low fuel consumption and adequate generator performance, are ensured in the various phases of flight, such as take-off, landing or cruise. The respective alteration required of the angle of attack $\alpha$ of the stator vanes is, in dependence of the temperature prevailing in the respective stage of the compressor or the turbine, accomplished via actuating elements which temperature-dependently expand, i.e. stretch, grow or deform, being made of materials with temperature-dependent expansion or deformation behavior. Such actuating elements can be arranged even in very confined spaces in the rear stages of the compressors and turbines, with their operability being uncompromised by even very high temperatures.

The actuating elements can be connected to the upstream or downstream side of the stator vane, or they can be linked, while acting in opposite directions, to both sides thereof.

Preferably, the stator vanes are each connected to a retaining plate whose downstream and upstream end portions are each swivellable in a groove of the inner casing or rotatable about a pivot, respectively.

The actuating element can be a bimetal pin which is either axially oriented and held with its fixed end on the inner casing or a component fixed thereto, or radially oriented and held with its fixed end on the outer casing or a component fixed thereto, while the free end, moving under thermal influence, acts upon the swivellable side of the stator vane or the retaining plate, respectively.

In a further development of the present invention, the outer casing provided with radially oriented actuating pins can also be used as an actuating element due to a temperature and/or material-due elongation behavior differing from that of the inner casing. The free end of the actuating pin has an end portion which, being obliquely oriented and extending transversely to the axial direction, engages a likewise obliquely oriented recess on the stator vane, so that the angle of attack $\alpha$ of the stator vane is altered as the distance between inner and outer casing changes under thermal influence.

In a further development of the present invention, the actuating element can also be an expansion setting ring which is radially located with expansion clearance on the outer casing and on whose inner periphery obliquely oriented recesses are provided transversely to the axial direction, each of which is engaged by an obliquely oriented actuating pin originating at the stator vane. Thus, the temperature-dependent elongation of the expansion setting ring enables the angle of attack $\alpha$ of the stator vanes to be varied.

In a further development of the present invention, the actuating element is a circumferentially arranged expansion pin which is connected to the respective stator vane and the inner casing and is made of a material whose length varies as temperature changes. This expansion pin can also be integrally formed onto the stator vane, for example on an end face of the retaining plate of the stator vane, while the free end of the expansion pin is linked to the inner casing.

Figure 2:
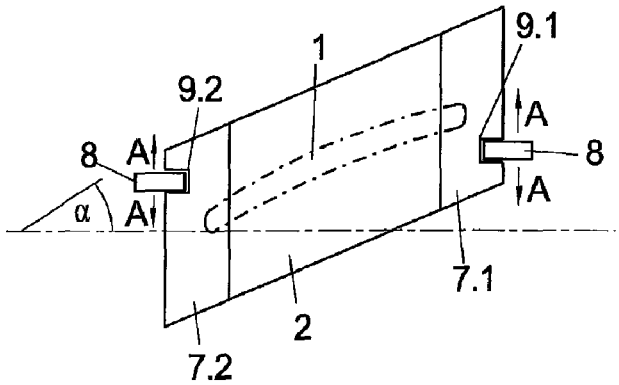
Figure 3:
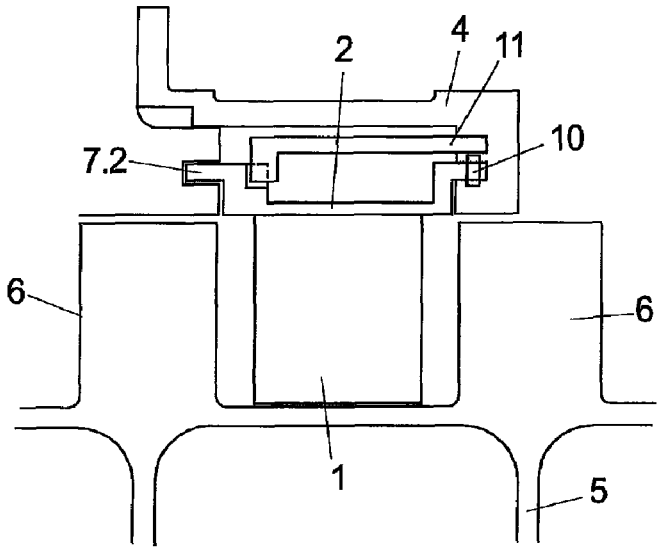
Figure 4:
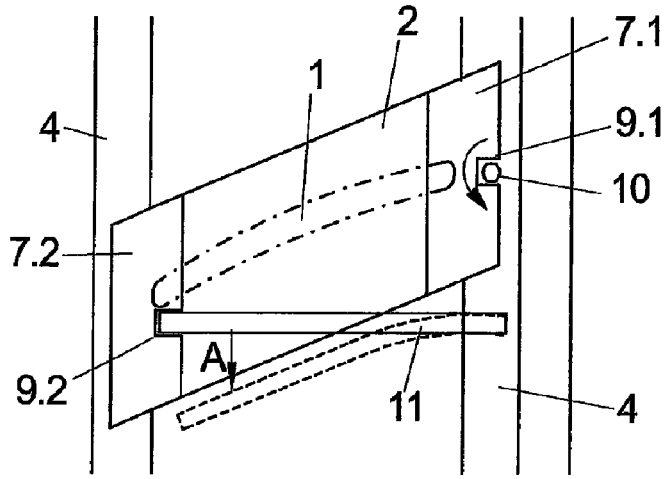
Figure 5:
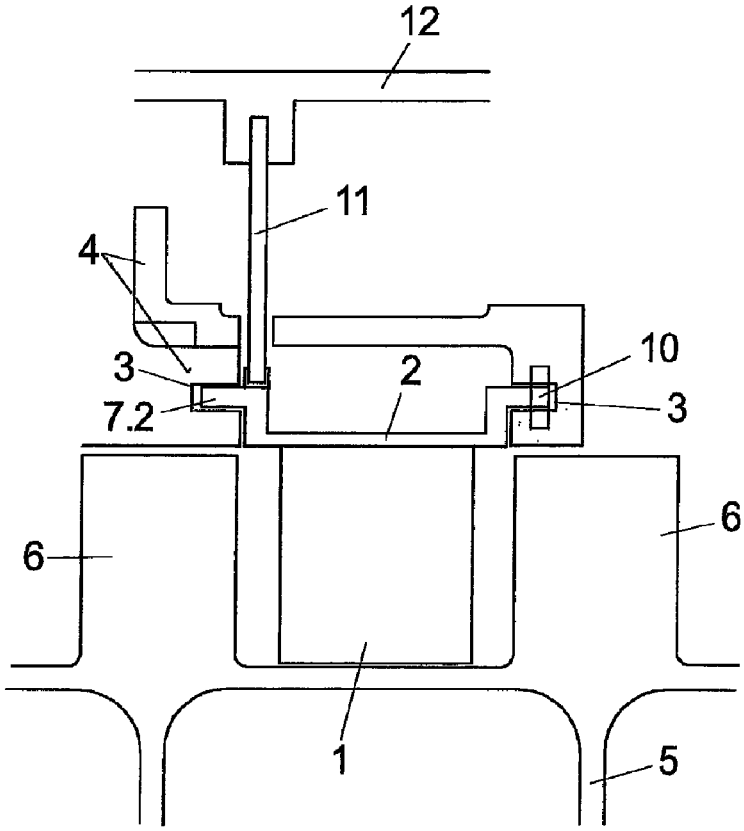
Figure 6:
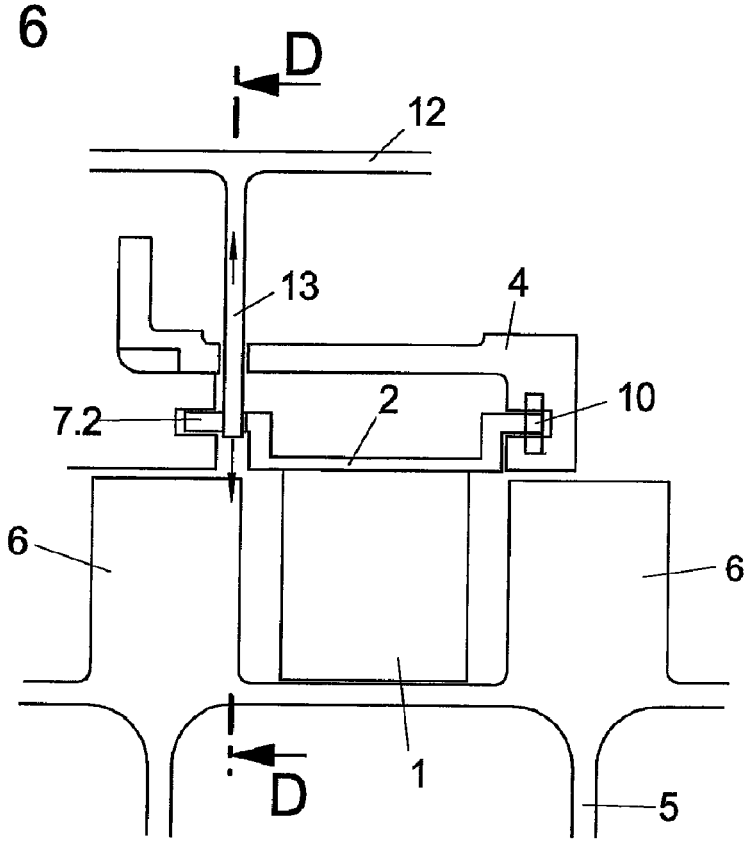
Figure 7:
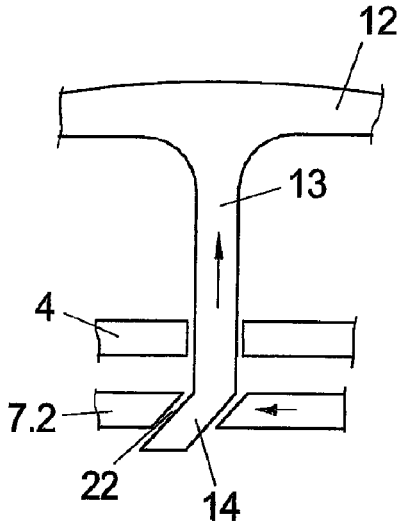
Figure 8:
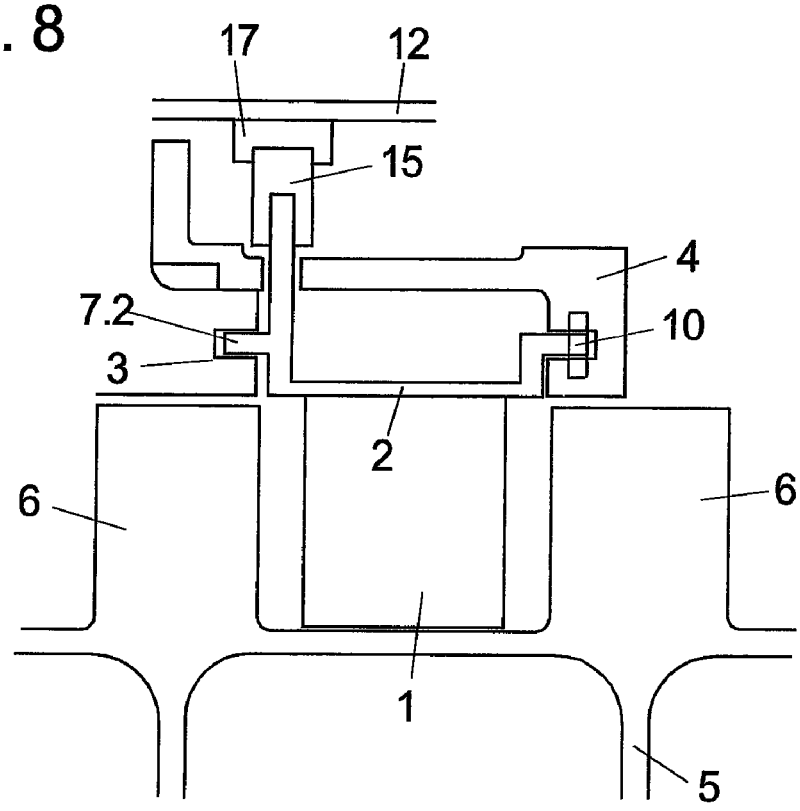
Figure 9:
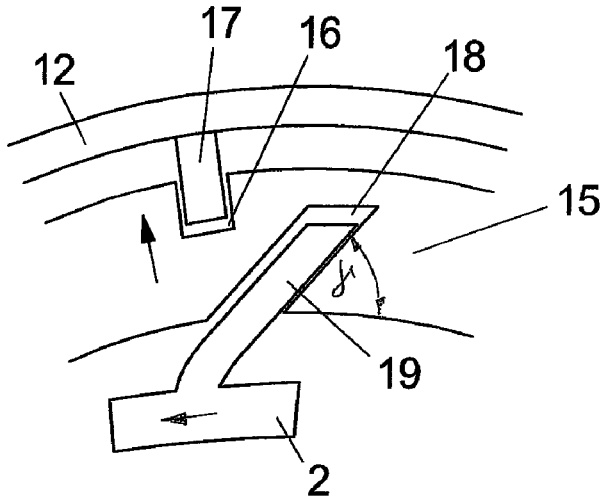
Figure 10:
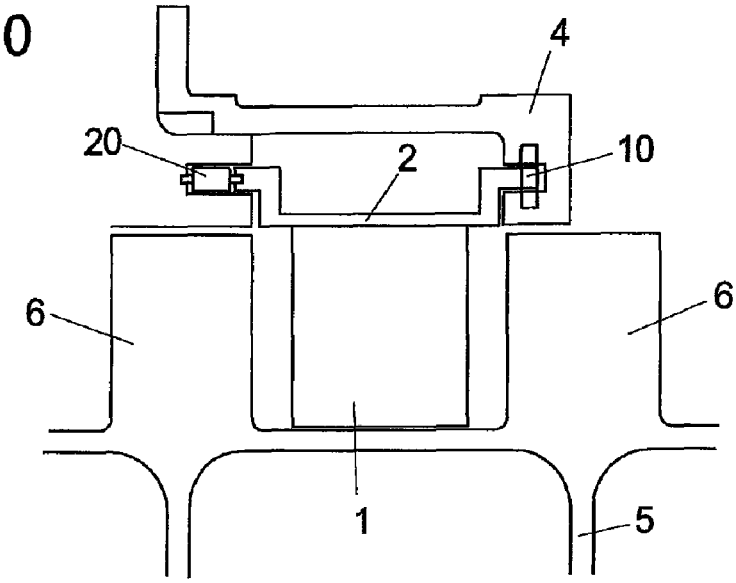
Figure 11:
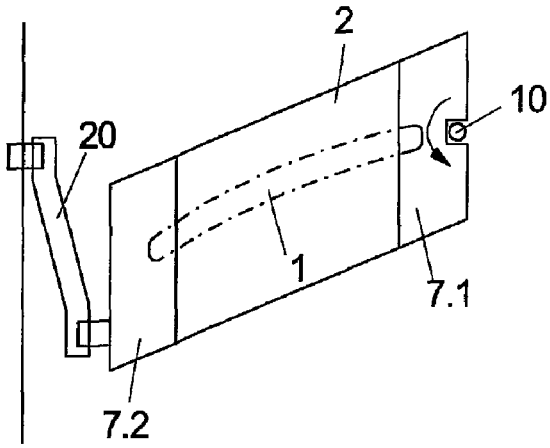
Figure 12:
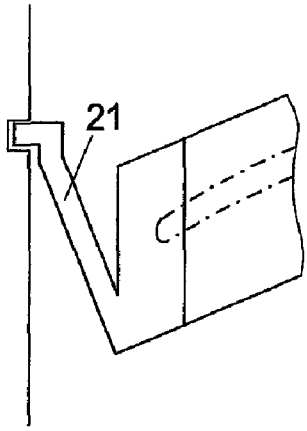

Embodiments of the present invention are more fully described in light of the accompanying drawings. In the drawings:

FIG. 1 is a side view representing the inventive principle of a stator vane held between two rotor blades on the inner casing and being swivellable via actuating elements about a vertical axis, FIG. 2 is a top view of the retaining plate (platform) of the stator vane with the two actuating elements acting upon the retaining plate, FIG. 3 is a side view of a stator vane swivellable via a bimetal pin, FIG. 4 is a top view of the blade platform as per FIG. 3 connected to the bimetal pin, FIG. 5 is a side view of a stator vane swivellable via a bimetal pin held on the outer casing, FIG. 6 is a side view of a stator vane swivellably held on the inner casing, with the stator vane being linked to an actuating pin attached to the outer casing, FIG. 7 is a section D-D as per FIG. 6, representing the engagement of a slope connected to the actuating pin in a groove of the retaining plate, FIG. 8 is a side view of a stator vane swivellably held on the inner casing with an oblique actuating pin provided on the stator vane, engaging in an oblique setting groove of an expansion setting ring held on the outer casing, FIG. 9 is a detailed representation as per FIG. 8, FIG. 10 is a side view of a stator vane swivellably held on the inner casing, the retaining plate of which is linked to the inner casing via an expansion pin, FIG. 11 is a top view of the retaining plate of the stator vane with the expansion pin as per FIG. 10 linked to the retaining plate, and FIG. 12 is a top view of a variant as per FIG. 10, with the expansion pin being integrally formed onto the retaining plate.

FIG. 1 shows a stator vane 1 which, by a retaining plate 2 connected to it, is held in recesses 3 of the inner casing 4 of a compressor or a turbine of a gas-turbine engine. The stator vane 1, or the stator vane array or stator assembly formed by a plurality of stator vanes, is disposed between upstream and downstream rotor blades 6 arranged on a rotor disk 5, with the stationary stator vanes 1 being conceived to guide the air or hot gas flow to the rotor blades 6 at an angle, and thus at a corresponding angular position of the stator vanes 1, best suited to the operating state of the engine or the respective flying phase, namely take-off, climb, cruise, landing, to ensure stable and efficient operation of the engine, i.e. with stable airflow in all flying phases and low fuel consumption as well as simultaneous generation of the electrical power required. FIG. 1 and the top view shown in FIG. 2 of a retaining plate 2 or stator vane 1, respectively, inclined at the angle $\alpha$ embody the basic idea of the present invention, according to which the opposite end portions 7.1, 7.2 of the retaining plate 2, which are each moveably located in the recesses 3 of the inner casing 4, are each acted upon by an actuating element 8 which is changed in form and length by the temperature prevailing at the respective position in the compressor or the turbine and which transmits this form change to one of the two end portions 7.1. or 7.2 or—in opposite direction—to both end portions 7.1 and 7.2, thereby automatically angulating the stator vanes 1 about their longitudinal axis in dependence of the respective temperature prevailing in the compressor or turbine in the respective stage. In FIG. 2, arrowheads A indicate the direction in which the actuating elements 8 change their position and the angulation of the retaining plate 2 or the stator vane 1, respectively, to ensure optimum inflow to the downstream rotor blades 6 and, thus, stable and efficient engine operation.

As shown in FIGS. 3 and 4, the retaining plate 2 is at the downstream first end portion 7.1 flexibly held in the recess 3 by way of a locating pin 10 engaging a downstream rear groove 9.1. The above mentioned actuating element 8 is here provided as an axially arranged bimetal pin 11 which, on the side of the downstream, rear end portion 7.1, is firmly attached to the inner casing 4, while its opposite, free end engages a forward groove 9.2 provided on the upstream, forward end portion 7.2. In the case of a temperature change, the bimetal pin 11 deflects in accordance with its temperature behavior, changing the angle of attack $\alpha$ of the stator vane 1 in accordance with the respective temperature change.

FIG. 5 shows yet another embodiment of the actuation of the stator vanes 1 via an actuating element 8 provided as bimetal pin 11. Here, a radially oriented bimetal pin 11 passing through the inner casing 4 is, at the one end, firmly connected to the outer casing 12, or a component circumferentially fixed to the latter, and engages, with its inward end, the forward groove 9.2, so that the angle of attack of the stator vanes is set, or changed, according to the temperature prevailing in the respective compressor or turbine stage, in accordance with the temperature behavior of the bimetal pin 11. The actuating element 8, here the bimetal pin 11, requires only very small space, enabling it to be arranged in areas of the compressor or the turbine which are very confined and include small parts, in particular since the operation of the actuating element is not affected by the high temperatures existing there and, furthermore, the actuating elements have low weight.

According to the variant shown in FIGS. 6 and 7, the temperature-dependently operating actuating element 8 is a radially inwardly directed actuating pin 13 which is integrally connected to the outer casing 12 and has an inclined end portion 14 engaging an inclined recess 22 in the forward end portion 7.2 of the retaining plate 2. At the rearward end portion 7.1, the retaining plate 2, as in the above described embodiments, is flexibly held via a locating pin 10 engaging the rearward groove 9.1. In the case of a temperature change between the inner casing 4 and the outer casing 12, and a resultant change in distance between the inner casing and the outer casing, the inclined end portion 14 of the actuating pin 13 is moved in the radial direction. In the process, the retaining plate 2 is moved along the slope, thereby altering the angle of attack of the stator vane 1 in dependence of the temperature.

In yet another embodiment of the present invention shown in FIGS. 8 and 9, the actuating element is an expansion setting ring 15 which grows as temperature increases and is provided, on the outer circumference, with circumferential grooves 16 which are engaged by guiding elements 17 provided on the inner circumference of the outer casing 12. On the inner circumference of the expansion setting ring 15, a setting groove 18 inclined at an angle $\gamma$ is provided opposite of each stator vane 1 and is engaged by an actuating pin 19 obliquely formed onto the forward end portion 7.2 of the retaining plate 2. The downstream end portion 7.1 of the retaining plate 2 is again linked to the inner casing 4 by locating pin 10. As the expansion setting ring 15 expands or contracts under the effect of a temperature change, the oblique setting groove 18 changes its radial position relative to the inner casing 4, thereby acting upon the actuating pin 19 guided therein, angularly varying the stator vane 1 about a vertical axis towards the one or the other side. The smaller the angle $\gamma$, or the more pronounced the slope, the greater the variation angle of the stator vane 1 at equal expansion of the expansion setting ring 15.

A further variant for altering the angle of the stator vanes 1 by a temperature-dependently operating actuating element is shown in FIGS. 10 to 12. At the rear end portion 7.1 of the retaining plate 2, the stator vane 1 is again flexibly held by the locating pin 10. Linked to the forward end portion 7.2 of the retaining plate 2 and connected, at the opposite end, to the inner casing 4, an expansion pin 20 forming the actuating element and assuming a certain length under the influence of heat is provided which changes its length as the temperature changes, thereby varying the angle of the stator vane 1. As shown in FIG. 12, angular variation in accordance with the above variant can also be effected with an expansion pin 21 integrally formed onto the retaining plate 2.

The present invention is not limited to the variants explained in the above. Other modifications can be made to the broad concept of the present invention, according to which a gas-turbine engine is provided with actuating elements for variably setting the angle of attack of the stator vanes in any of the areas of the compressor and/or turbine, in particular those where space is very confined or which are exposed to high temperatures, effecting angular variation of the stator vanes solely by the thermal behavior of the respective materials used for the actuating elements. In particular, different materials with different thermal behavior can be used for the actuating elements, which can also operate on the rearward end portion 7.1 or, in opposite directions, on both end portions. Since the actuating elements operate in dependence of the temperatures prevailing under the respective operating conditions and solely by virtue of their thermal expansion behavior, they require small space and can be arranged also in areas of the compressor and the turbine in which space is confined and which are exposed to high temperatures, thereby providing for stable and economic operation of the engine in accordance with the respective operating conditions.

List of Reference Numerals

1 Stator vane
2 Retaining plate
3 Recesses in 4
4 Inner casing
5 Rotor disk
6 Rotor blade
7.1 Downstream end portion of 2
7.2 Upstream end portion of 2
8 Actuating element (FIGS. 1, 2)
9.1 Downstream groove of 7.1
9.2 Upstream groove of 7.2
10 Locating pin of 9.1
11 Bimetal pin (radially or axially oriented)
12 Outer casing
13 Actuating pin of 12
14 Inclined end portion of 13
15 Expansion setting ring
16 Circumferential groove of 15
17 Guiding element of 12
18 Oblique setting groove of 15
19 Oblique actuating pin of 1
20 Expansion pin
21 Integral expansion pin of 1
22 Inclined recess of 7.2

What is claimed is:

1. A gas-turbine engine comprising:
an outer casing;
an inner casing;
a plurality of stator vanes mounted within the inner casing so as to be angularly variable about respective longitudinal axes;
at least one actuating element connected to the plurality of stator vanes for angularly varying the stator vanes about their longitudinal axes in order to control an airflow supplied to downstream rotor blades;
wherein the at least one actuating element is arranged in downstream, confined stages of at least one of a compressor or a turbine and enclosed by the inner casing and the outer casing, with the stages being exposed to high temperatures, and that the at least one actuating element is fixed to the inner casing and outer casing and made of a material that at least one of expands, contracts and deforms in dependence of a temperature prevailing in respective stages, thereby transmitting a temperature-dependent change in at least one of shape and length to the stator vanes linked to the at least one actuating element;
wherein the at least one actuating element is linked to one of a forward end aortion and a rearward end portion of one of the stator vanes and the other of the forward end portion and the rearward end portion of the stator vane is flexibly held on the inner casing.

2. A gas-turbine engine comprising:
an outer casing;
an inner casing;
a plurality of stator vanes mounted within the inner casing so as to be angularly variable about respective longitudinal axes;
at least one actuating element connected to the plurality of stator vanes for angularly varying the stator vanes about their longitudinal axes in order to control an airflow supplied to downstream rotor blades;
wherein the at least one actuating element is arranged in downstream, confined stages of at least one of a compressor or a turbine and enclosed by the inner casing and the outer casing, with the stages being exposed to high temperatures, and that the at least one actuating element is fixed to the inner casing and outer casing and made of a material that at least one of expands, contracts and deforms in dependence of a temperature prevailing in respective stages, thereby transmitting a temperature-dependent change in at least one of shape and length to the stator vanes linked to the at least one actuating element;
wherein the at least one actuating element is a bimetal pin that bends under temperature changes to move at least one of the stator vanes.

3. The gas-turbine engine of claim 2, wherein the bimetal pin is axially oriented and a fixed end of the bimetal pin is connected to at least one of the inner casing and a component circumferentially fixed to the inner casing.

4. The gas-turbine engine of claim 2, wherein the bimetal pin is radially oriented and a fixed end of the bimetal pin is connected to at least one of the outer casing and a component circumferentially fixed to the outer casing.

5. A gas-turbine engine comprising:
an outer casing;
an inner casing;
a plurality of stator vanes mounted within the inner casing so as to be angularly, variable about respective longitudinal axes;
at least one actuating element connected to the plurality of stator vanes for angularly varying the stator vanes about their longitudinal axes in order to control an airflow supplied to downstream rotor blades;
wherein the at least one actuating element is arranged in downstream, confined stages of at least one of a compressor or a turbine and enclosed by the inner casing and the outer casing, with the stages being exposed to high temperatures, and that the at least one actuating element is fixed to the inner casing and outer casing and made of a material that at least one of expands, contracts and deforms in dependence of a temperature prevailing in respective stages, thereby transmitting a temperature-dependent change in at least one of shape and length to the stator vanes linked to the at least one actuating element;
wherein the at least one actuating element is an expansion pin, extending in a circumferential direction and connected to at least one of the stator vanes and the inner casing, and made of a material varying in length as temperature changes;
wherein the expansion pin is a separate component fixed to the inner casing and to at least one of the stator vanes.

6. A gas-turbine engine comprising:
an outer casing;

an inner casing;

a plurality of stator vanes mounted within the inner casing so as to be angularly variable about respective longitudinal axes;

at least one actuating element connected to the plurality of stator vanes for angularly varying the stator vanes about their longitudinal axes in order to control an airflow supplied to downstream rotor blades;

wherein the at least one actuating element is arranged in downstream, confined stages of at least one of a compressor or a turbine and enclosed by the inner casing and the outer casing, with the stages being exposed to high temperatures, and that the at least one actuating element is fixed to the inner casing and outer casing and made of a material that at least one of expands, contracts and deforms in dependence of a temperature prevailing in respective stages, thereby transmitting a temperature-dependent change in at least one of shape and length to the stator vanes linked to the at least one actuating element;

wherein the at least one actuating element is an expansion pin, extending in a circumferential direction and connected to at least one of the stator vanes and the inner casing, and made of a material varying in length as temperature changes;

wherein the expansion pin is a component integrally connected to at least one of the stator vanes and fixed to the inner casing.

* * * * *